United States Patent [19]

Yaguinuma

[11] 3,967,078

[45] June 29, 1976

[54] TIME SWITCH MECHANISM

[75] Inventor: Jyusuke Yaguinuma, Koriyama, Japan

[73] Assignee: Copal Company Limited, Tokyo, Japan

[22] Filed: Oct. 29, 1974

[21] Appl. No.: 518,874

[30] Foreign Application Priority Data

Oct. 29, 1973 Japan ..... 48-125139[U]

[52] U.S. Cl. ..... 200/38 R; 58/19 R; 58/20; 58/38 R; 200/35 R; 200/38 A; 200/38 FB

[51] Int. Cl.[2] ..... H01H 43/10; G04C 21/16

[58] Field of Search..... 200/33 R, 35 R–38 FB, 200/38 D, 38 DA, 39 R, 39 A; 58/9, 16, 19 R, 20, 21.13–21.15, 33, 38

[56] References Cited

UNITED STATES PATENTS

| | | | |
|---|---|---|---|
| 2,951,919 | 9/1960 | Boyles | 200/38 FA |
| 3,131,267 | 4/1964 | Schneiter | 58/20 X |
| 3,264,817 | 8/1966 | Beguin | 58/21.15 |
| 3,324,644 | 6/1967 | Beguin | 200/38 R X |
| 3,625,000 | 12/1971 | Hermle | 200/35 R X |
| 3,679,850 | 7/1972 | Arzt et al. | 200/37 R |
| 3,708,973 | 1/1973 | Funaki | 200/38 R X |
| 3,825,702 | 7/1974 | Murata et al. | 200/35 R |
| 3,896,277 | 7/1975 | Yoginuma | 200/38 R |

*Primary Examiner*—James R. Scott
*Attorney, Agent, or Firm*—Oblon, Fisher, Spivak, McCelland & Maier

[57] ABSTRACT

A time switch mechanism for automatically as well as manually operating a switch incorporated therein for the purpose of controlling the operation of a device such as a television or a radio, as well as a sleep timer. The time switch mechanism comprises a timing cam, a time setting member, a normally closed microswitch for operating the television or radio, a switch lever for operating the microswitch and cooperable with the timing cam and a switching cam, wherein the switching cam is operably secured to a sector gear which is rotatable at a predetermined speed.

1 Claim, 6 Drawing Figures

12
8c
9
13
8
11
8d
8a
14
10
5b
5a
14b
14a
8e
4
8b
4a
6
7
5
3a
5c
3
1a
1
2

12
8c
9
13
8
11
14a
8a
10
8d
5a
14
4a
14b
4
8e
5b
8b
7
6
5
3a
5c
1a
3
1
2

TIME SWITCH MECHANISM

BACKGROUND OF THE INVENTION

The present invention relates to a time switch mechanism and, more particularly to a time switch mechanism adapted to be incorporated in a television, a radio and the like and capable of automatically as well as manually operating a switch for playing music or generating an alarm.

In general, a time switch of the type described above is so operated that the electrical power switch is automatically closed by a clock mechanism at a predetermined set time and, after the lapse of a set time period, the electric power switch is opened and the electrical power switch is again closed and opened at the set times, respectively, in the next day, and the above sequence is repeated daily. It is also desired that the time switch is closed and opened manually at desired times, respectively. Further, the time switch is used as a so-called sleep timer in which the switch is closed for a desired time period before the sleeping time and then opened until the set time is reached for closing the switch.

The above described types of the time switch have been proposed and widely used. However, in the prior art time switches, all of them are provided with a plurality of switches, each exclusively adapted to be operated automatically by a clock mechanism, or to be operated manually or to be operated as a sleep timer, thereby resulting in complicated mechanical as well as electrical construction and high cost of the time switch mechanism while the operation is made complicated.

The present invention aims at avoiding the above described disadvantages of the prior art time switch mechanisms.

SUMMARY OF THE INVENTION

The object of the present invention is to provide a novel and useful time switch mechanism which is simple in construction and inexpensive and easy to operate and in which only a single switching member and a single switch are provided in order to permit the above described automatic control by a clock mechanism and manual control as well as control, for the sleep timer, to be carried out.

The above object is achieved in accordance with the present invention by providing a time switch mechanism having a switch to be opened and closed thereby, the switch mechanism being characterzied by a switch lever urged to be rotated from a first terminal position through an intermediate position to a second terminal position and operably coupled with the switch for operating the same to its one position when the switch lever is positioned at the first and the second terminal position while the switch is switched to its other position when the switch lever is positioned at the intermediate position, a switching cam operably coupled with the switch lever, an adjustable time setting member for adjustably setting an operating time, and an axially movable timing cam rotated at a predetermined speed and coupled with the time setting member so that the timing cam is moved axially to a first position when the operating time set by the time setting member is reached while the timing cam is held at a second position before the operating time is reached as well as after the lapse of a predetermined time after the operating time is reached, and the timing cam being operably coupled with said switch lever.

In accordance with an embodiment of the present invention, a gear frictionally rotated at a predetermined speed is provided and a sector gear is secured integrally with the switching cam, the sector gear being so positioned that it meshes with the gear when a portion of the switching cam is engaged with the switch lever to position the switch at its one position, thereby permitting the switching cam to be switched to its first position by the gear engaging with the sector gear allowing the switch lever to move between its intermediate position and its second terminal position, thus rendering the switch mechanism to be used as a sleep timer.

DETAILED DESCRIPTION OF THE PREFERRED EMBODIMENTS

Figure 1:
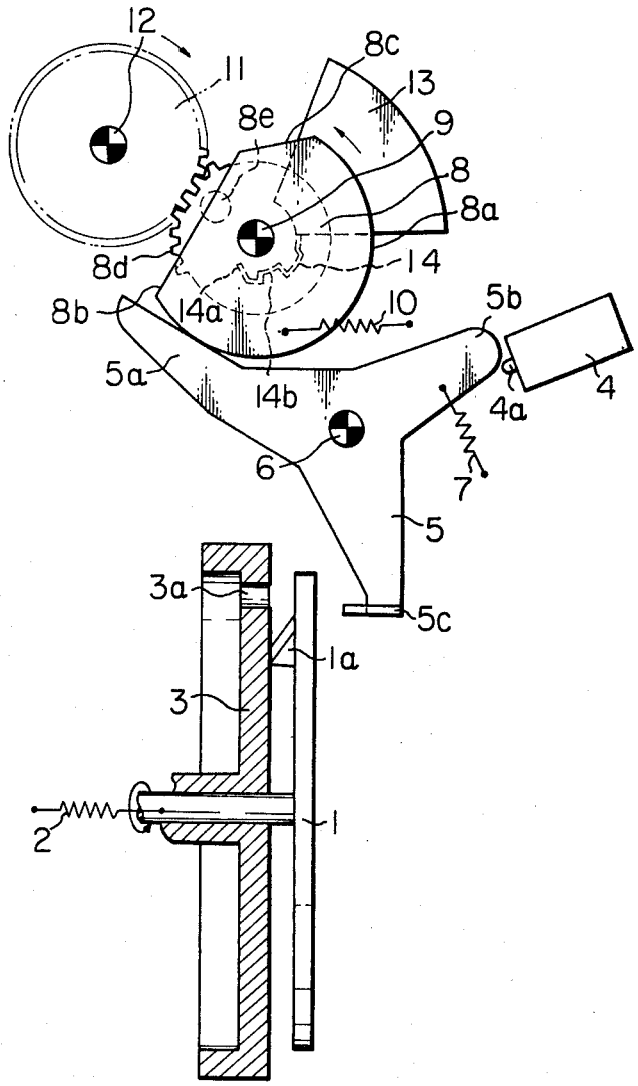
FIG. 1 is a schematic view partly in section showing a first embodiment of the switch mechanism of the present invention.

Referring to FIG. 1, a disc-like timing cam 1 having a projection 1*a* formed at its one side surface is rotated in the direction indicated by the arrow at a predetermined speed, for example, one revolution per 24 hours, by a clock mechanism (not shown) and is supported axially shiftably and urged toward the left by a spring 2. A disc-like time setting member 3 having a recess 3*a* formed therein is coaxially supported with respect to the timing cam 1 adjacent thereto so that the timing cam 1 is urged against the time setting member 3 by the spring 2. The angular position of the time setting member 3 is adjustable so that the operating time is set by the angular position of the time setting member 3. The projection 1*a* of the timing cam 1 is provided with an inclined leading edge and normally abuts against the side surface of the time setting member 3 so as to keep the timing cam 1 spaced a small distance from the time setting member 3, but, when the projection 1a of the timing cam 1 fits in the recess 3*a* of the time setting member 3 as the timing cam 1 rotates, the timing cam 1 is moved axially toward the time setting member 3 to abut against the same, and after the lapse of a predetermined time period determined by the length of the recess 3*a*, the projection 1a is disengaged from the recess 3*a* so that the timing cam 1 is again moved apart from the time setting member 3 to assume the original position.

A switch lever 5 having radially extending arms 5*a*, 5*b* and 5*c* is rotatably supported by a shaft 6, and urged by a spring 7 in the clockwise direction. The bent lug of the arm 5*c* is positioned adjacent to the timing cam 1 as shown, while the arm 5*b* is positioned adjacent to the actuator 4a of a microswitch 4 so that the switch 4 is actuated by the arm 5*b* when the switch lever 5 is rotated in the clockwise direction to move the arm 5*b* across the actuator 4*a*.

Figure 3:
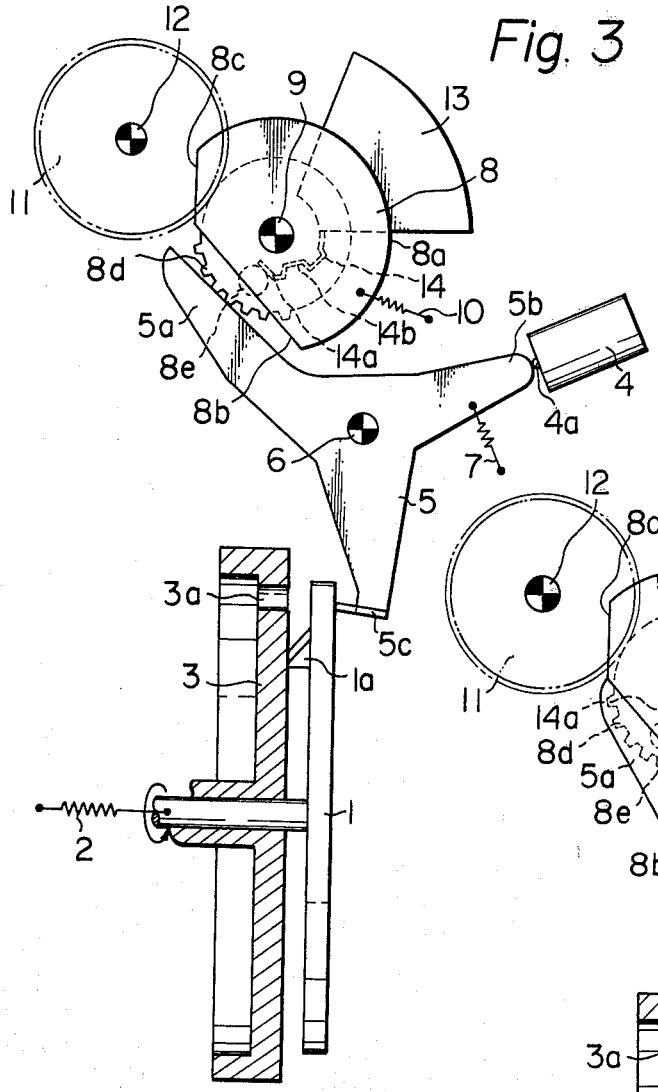
FIG. 3 is a schematic view of the embodiment shown in FIG. 1, illustrating the position of the parts thereof when a preselected time period has elapsed and the switch has been actuated, for example, to turn off a television or radio.
Figure 4:
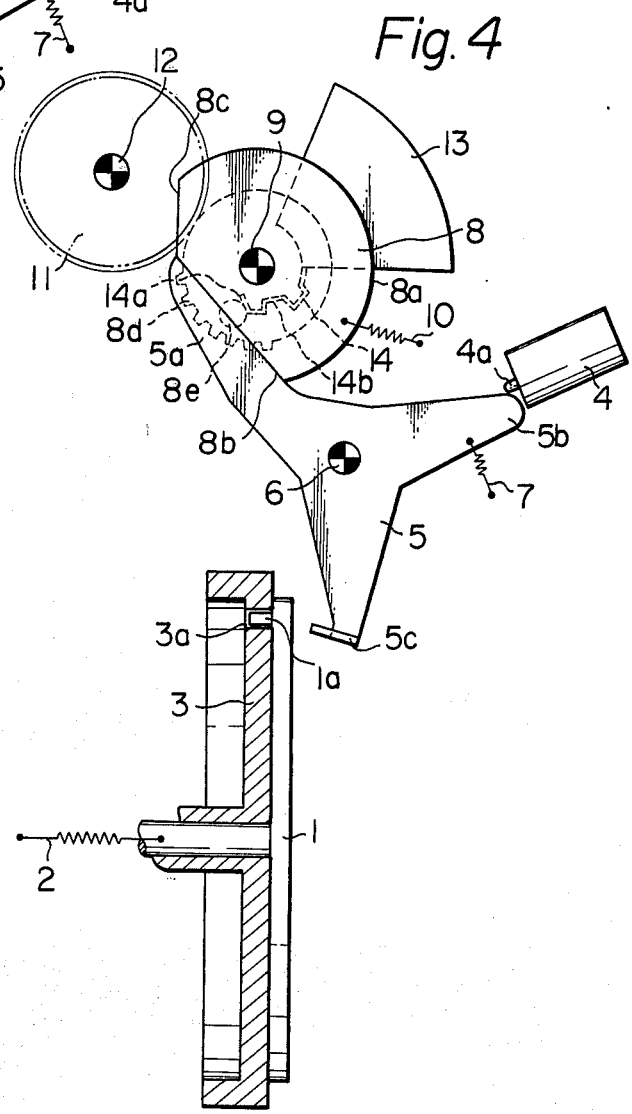
FIG. 4 is a schematic view of the embodiment illustrated in FIGS. 1 and 3, showing the parts thereof in the position wherein the switch of a television or radio has again been turned on after a predetermined period of sleeping time.
Figure 5:
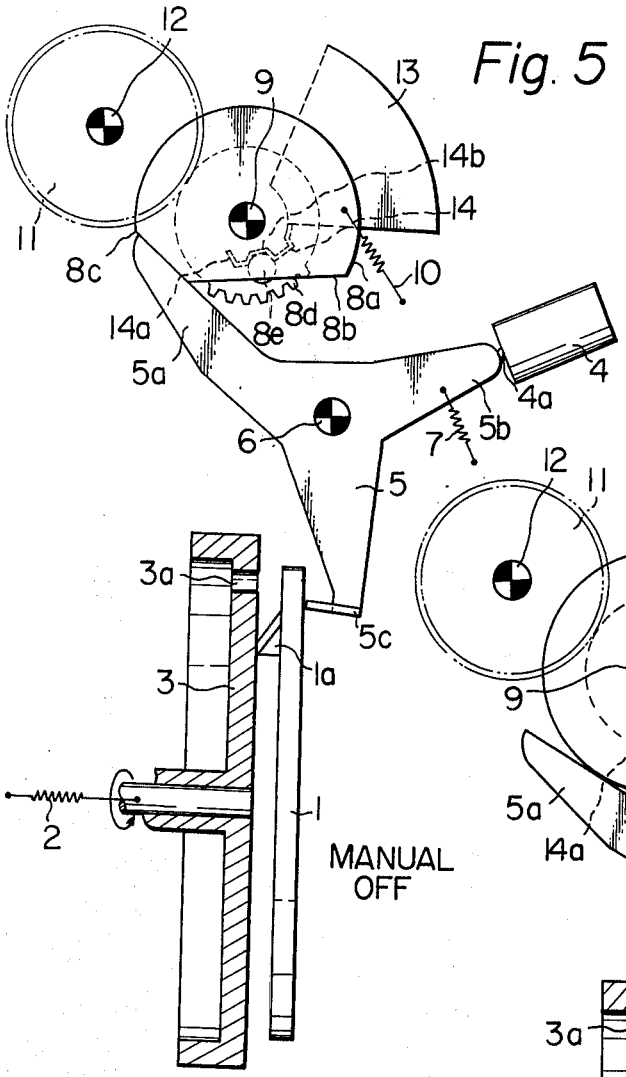
FIG. 5 is a schematic view of the first embodiment of the invention, as illustrated in FIGS. 1, 3 and 4, but showing a manually set condition of the switch for turning off, for example, a television or radio.

A switching cam 8 having cam portions 8*a*, 8*b* and 8*c* each adapted to cooperate with the arm 5*a* of the switch lever 5 is rotatably supported by a shaft 9 and urged by a spring 10 in the counterclockwise direction. The configuration of the cam portions 8*a*, 8*b*, 8*c* is so determined that the arm 5*b* is arrested as a position apart from the actuator 4*a* of the switch 4 during counterclockwise direction of rotation of the switch lever 5 from the position shown in FIG. 1, when the cam portion 8*a* contacts the arm 5*a*. On the other hand, the arm 5*b* is made movable in the clockwise direction between a position at which the arm 5*b* contacts and actuates the actuator 4*a* of the switch 4 and a position apart from the actuator 4*a* when the cam portion 8*b* of the switching cam 8 is faced against the arm 5*a*, as shown in FIGS. 3 and 4, and, when the cam portion 8*c* abuts against the arm 5*a*, the arm 5*b* is arrested at the position at which the arm 5*b* actuates the actuator 4*a* of the switch 4, as shown in FIG. 5.

Figure 6:
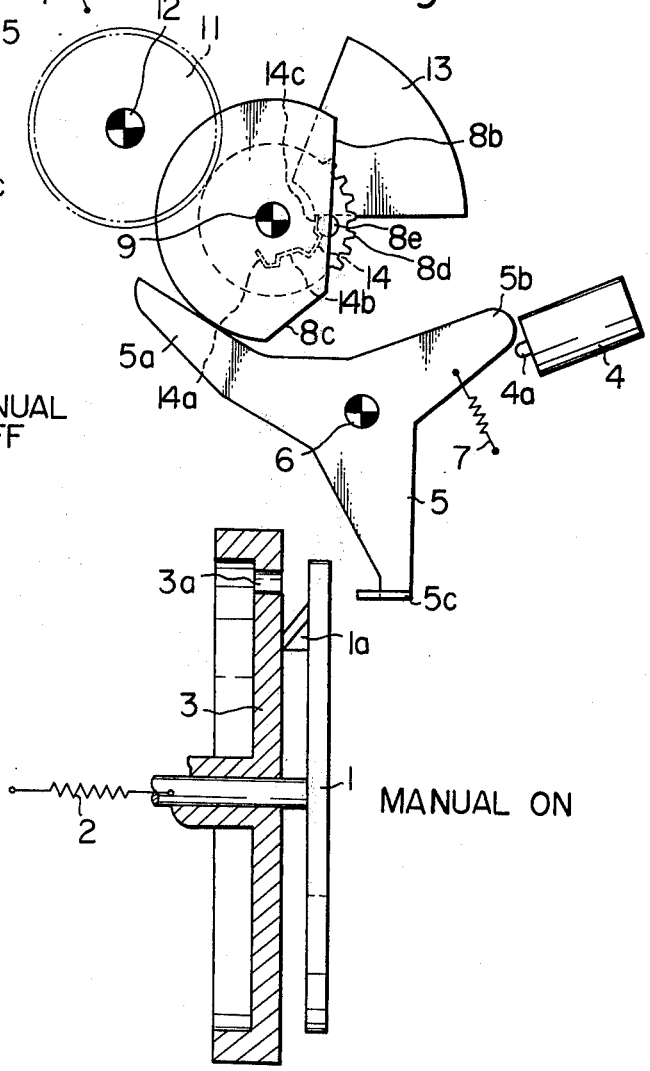
FIG. 6 is a schematic view of the first embodiment of the present invention, as illustrated in FIGS. 1, 3, 4 and 5, showing the manually set condition of the parts thereof for maintaining the television or radio in an operative state.

The configuration of the arm 5*c* of the switch lever 5 is so determined that, when the cam portion 8*a* is engaged with the arm 5*a*, the arm 5*c* is held apart from the timing cam 1 when the same is held apart from the time setting member 3 by the projection 1a so that the switch lever 5 is absolutely isolated from the actuation of the timing cam 1, as shown in FIGS. 1 and 6. When the cam portion 8b is faced against the arm 5*a*, as shown in FIG. 3, the arm 5*c* abuts against the timing cam 1 when the same is held apart from the time setting member 3 by the projection 1*a*, so that the arm 5*b* actuates the actuator 4*a* of the switch 4 with a certain clearance held between the cam portion 8*b* and the arm 5*a*. However, when the timing cam 1 is moved toward the time setting member 3 by the engagement of the projection 1*a* with the recess 3*a* at the set operating time as the timing cam 1 rotates, the arm 5*c* is allowed to follow the movement of the timing cam 1 by virtue of the clearance held between the cam portion 8*b* and the arm 5*a* so that the arm 5*b* moves in the clockwise direction of rotation of the lever 5 and is disengaged from the actuator 4*a* so as to deactuate the switch 4. When the cam portion 8*c* is faced against the arm 5*a*, the cam portion 8*c* abuts against the arm 5*a* or the same is moved closely adjacent to the arm 5*a* while the arm 5*c* abuts against the timing cam 1 held apart from the time setting member 3 by the projection 1a, as shown in FIG. 5, the arm 5*b* is held at the position at which it continues to actuate the switch 4 regardless of the movement of the timing cam 1 at the operating time. This is because of the fact that the switch lever 5 is arrested at the position at which the arm 5*b* continues to actuate the switch 4 because the cam portion 8*c* abuts against the arm 5*a* even immediately after the movement of the timing cam 1 toward the time setting member 3 at the operating time, thereby preventing the arm 5*b* from moving apart from the position at which the same actuates the switch 4.

A sector gear 8*d* is integrally secured to the switching cam 8 and the sector gear 8*d* is adapted to mesh with a gear 11 which is frictionally supported by a shaft 12 rotated at a predetermined speed in the clockwise direction as shown, so that the switching cam 8 is rotated in the counterclockwise direction during the time the sector gear 8*d* meshes with the gear 11.

The sector gear 8*d* is provided with a pin 8*e* secured thereto and the rotation of the sector gear 8*d* and, hence, the switching cam 8 is limited by a stopper 13 as shown. A leaf spring 14 having bent portions 14*a*, 14*b* is secured to the stopper 13. The spring 14 serves to temporarily hold the switching cam 8 at the position at which he cam portion 8*b* is faced against the arm 5*a* of the switch lever 5 by the abutment of the pin 8*e* against the bent portion 14*a* of the spring 14 when the switching cam 8 is rotated in the counterclockwise direction by the spring 10 after the disengagement of the sector gear 8*d* from the gear 11, as shown in FIGS. 3 and 4, while the switching cam 8 is temporarily held at the position at which the cam portion 8*c* abuts against the arm 5*a*, as shown in FIG. 5, when the pin 8e engages with the bent portion 14*b* of the spring 14, as the switching cam 8 is manually rotated in the counterclockwise direction so as to bring the pin 8*e* into the bent portion 14*b*.

When the switching cam 8 is further rotated manually in the counterclockwise direction and stopped by the stopper 13 engaged with the pin 8*e*, the cam portion 8*a* comes again into contact with the arm 5*a* so that the arm 5*c* is held apart from the timing cam 1 so as to be isolated from the actuation of the timing cam 1.

In operation, starting from the state shown in FIG. 1 and assuming that the switch 4 used in FIG. 1 is a normally closed switch, the sector gear 8*d* meshes with the gear 11 and the switch lever 5 is so positioned that the arm 5*a* contacts with the cam portion 8*a* of the switching cam 8. Thus the arm 5*b* is held apart from the switch 4 thereby maintaining the switch 4 in the closed position and the arm 5*c* is held apart from the timing cam 1. Therefore, when the sector gear 8*d* is rotated in the counterclockwise direction by the gear 11 and disengaged therefrom as the gear 11 rotates, the switching cam 8 is rotated in the same direction by the action of the spring 10 and the pin 8*e* is arrested by the bent portion 14*a* of the spring 14, as shown in FIG. 3, so that the switching cam 8 is held at the position at which the cam portion 8*b* is faced against the arm 5*a* of the switch lever 5. Thus, the switch lever 5 is allowed to rotate in the clockwise direction by the action of the spring 7, and, when the timing cam 1 is held apart from the time setting member 3 by the projection 1*a*, then the arm 5*c* abuts against the timing cam 1 and held in the position with a clearance being held between the arm 5*a* and the cam portion 8*b*, so that the arm 5*b* is held at the position at which it continues to actuate or open the switch 4. Therefore, by appropriately setting the initial position of engagement of the sector gear 8*d* with the gear 11, the switch mechanism of the present invention serves as the sleep timer by which the play of the television or the radio incorporating the switch mechanism therein is continued for a certain time period until the time for sleeping arrives, and, thereafter, the play is automatically stopped. After the switch 4 is opened, the timing cam 1 continues to rotate and, when the projection 1*a* is fitted in the recess 3*a* of the time setting member 3 at the operating time set thereby, the timing cam 1 is moved toward the time setting member 3 by the action of the spring 2 so that the arm 5*c* is allowed to follow the movement of the timing cam 1 by virtue of the clearance having been held between the cam portion 8*b* and the arm 5*a* switch lever 5, thereby permitting the arm 5*b* to move apart from the switch 4 by the rotation of the switch lever 5 in the clockwise direction until the arm 5*a* abuts against the cam portion 8*b* so as to close the switch 4, as shown in FIG. 4. In this case, the clockwise rotation of the switch lever 5 may be arrested by the timing cam 1 abutting against the arm 5*c* instead of the abutment of the arm 5*a* against the cam portion 8*b*. If the switching cam 8 is held in this position, the projection 1a is disengaged from the recess 3*a* after the lapse of the predetermined time period by the rotation of the timing cam 1 so that the timing cam 1 is moved apart from the time setting member 3 thereby urging the arm 5*c* in the counterclockwise direction so as to move the arm 5*b* to the position at which the arm 5*b* actuates the actuator 4*a* or opens the switch 4. Thereafter, the switch 4 is automatically closed and opened at the set operating time each time the timing cam 1 rotates one revolution. This operation is the automatic control by the switch mechanism.

When the switching cam 8 is manually rotated in the counterclockwise direction from the position shown in FIG. 1 to the position at which the cam portion 8*c* is faced against the arm 5*a* and set in this position, as shown in FIG. 5, the sector gear 8d is disengaged from the gear 11 after the same has been frictionally slid relative to the shaft 12 during the meshing of the gear 11 with the sector gear 8*d* and the switching cam 8 is held in this position by the engagement of the pin 8*e* with the bent portion 14*b* of the spring 14 despite the action of the spring 10. In this position, the arm 5*b* continues to actuate or open the switch 4 because the arm 5*c* is not influenced by the actuation of the timing cam 1 by virtue of the engagement of the cam portion 8*c* with the arm 5*a* and the gear 11 is held disengaged from the sector gear 8*d*. This operation is the manual operation for holding the switch 4 in the opened position.

When the switching cam 8 is further rotated manually in the counterclockwise direction until the pin 8*e* is arrested by the stopper 13, as shown in FIG. 6, so that the arm 5a engages with the cam portion 8*a*, the switch lever 5 is rotated in the direction against the action of the spring 7 so that the arm 5*b* is disengaged from the actuator 4*a* of the switch 4 and held in this position thereby maintaining the switch 4 in the closed position, because in this position, the sector gear 8*d* is held disengaged from the gear 11 and the arm 5*c* is held apart from the timing cam 1. This operation is the manual operation for closing the switch 4.

The spring 10 may be dispensed with in order to achieve the proper operation of the switch mechanism. In this case, the terminal position of the sector gear 8*d* is so set that the cam portion 8*b* comes to the position at which the same is faced against the arm 5*a* when the sector gear 8*d* is disengaged from the gear 11 as the same rotates. With this arrangement, the switch lever 5 is rotated in the clockwise direction during the time the sector gear 8*d* is still meshing with the gear 11 so that the switch 4 is switched. However, this condition is allowable in achieving the proper function of the switch mechanism.

Figure 2:
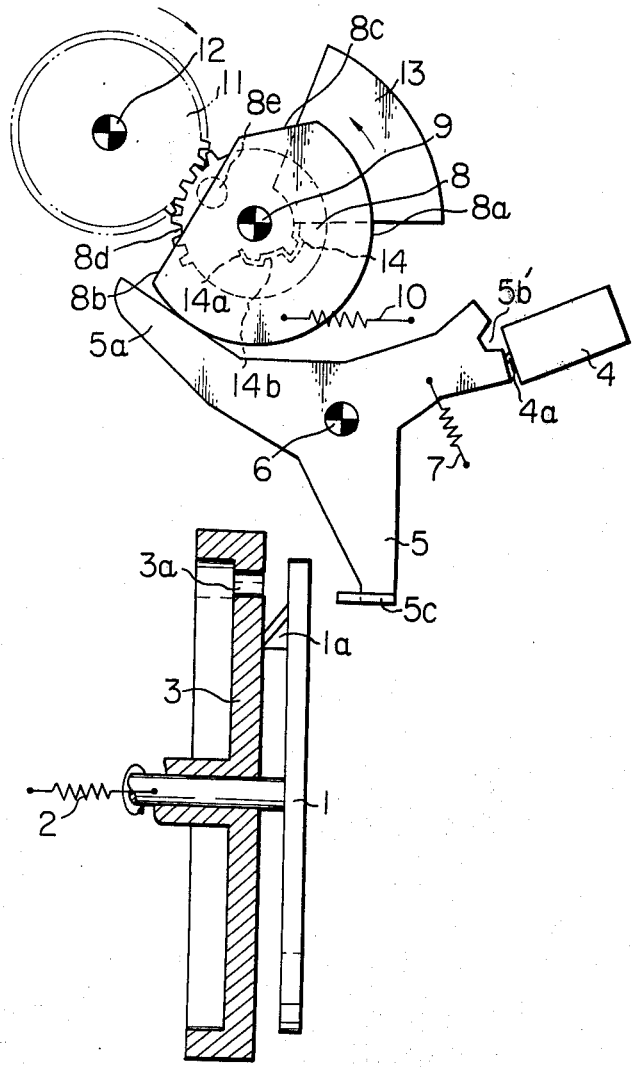
FIG. 2 is a schematic view similar to FIG. 1 but showing a second embodiment of the present invention.

FIG. 2 shows an alternative form of the present invention. This embodiment is substantially similar to that of FIG. 1 except that the configuration of the arm 5'*b* is made V-shape instead of the rounded shape of the arm 5*b* of FIG. 1 and the switch 4 is made a normally opened switch. The operation is the same with the embodiment of FIG. 1.

As described above, it is apparent that the present invention provides a useful switch mechanism simple in construction and inexpensive to manufacture and capable of functioning accurately as the automatic control and the manual control device of the appliance such as the television and the radio and the like as well as the sleep timer. All the functions are achieved by the provision of a single switch lever 5 cooperating with the switching cam 8 and the switch 4 without requiring a high accuracy of the machining and the complicated electric circuit.

I claim:

1. A time switch mechanism having switch means and a clock mechanism for automatically operating said switch means independently of the manual operation thereof, wherein the improvement comprises:

a switch lever rotatable about a given axis between a start position and a terminal position and being spring-biased toward said terminal position;

said switch means being positioned adjacent to said switch lever so that said switch means is actuated to one operating condition thereof by a first portion of said switch lever when the same is positioned at either of said start position and said terminal position, while said switch means is switched to the other operating condition when said switch lever is positioned at an intermediate position between said start position and said terminal position;

a rotary switching cam manually rotatably mounted adjacent to said switch lever and having a first, a second and a third cam portion and a pin formed thereon, being spring-biased for rotation in a direction from an initial position at which said first cam portion faces against a second portion of said switch lever to a position in which said second portion faces against said second cam portion, then against said third cam portion and thereafter again against said first cam portion;

click stop means cooperating with said pin of said switching cam for releasably holding said switching cam, respectively, at a first position at which said second cam portion faces against said second switch lever portion after said switch cam is rotated from said initial position, at a second position at which said third cam portion faces against said second lever portion and at a third position at which said first cam portion faces again against said second lever portion;

a sector gear integrally secured to said switching cam so as to be rotatable therewith;

a gear frictionally mounted on a rotatable shaft driven by said clock mechanism and engageable with said sector gear so as to drive said sector gear in the direction of rotation of said switching cam, the configuration of said sector gear being so determined that it is disengaged from said gear within the range of rotation of said switching cam before said switching cam is brought into said initial position thereof during its rotation;

a time setting member having engaging means manually settable to a desired set time; and a timing cam driven by said clock mechanism, being coaxially disposed with said time setting member, and having engaging means, said timing cam cooperating with said time setting member so that said timing cam is shifted from a first position to a second position at said set time by the engagement of said engaging means thereof with said engaging means of said time setting member during rotation of said timing cam, said timing cam being so positioned with respect to a third portion of said switch lever that the same is held in said intermediate position to maintain said switch means in said other operating condition when said timing cam is in said first position and said switching cam is in said initial position, while, when said timing cam is in said second position and said switching cam is in said first position, said switch lever is held in said terminal position to maintain said switch means in said one operating condition, said second position of said switching cam at which said third cam portion faces against second portion of said switch lever being so determined that said switch lever is prevented from rotating from said intermediate position to said terminal position, to maintain said switch means in said other operating condition regardless of the operation of said timing cam, thereby determining a first manual set position of said time switch mechanism, and said third position of said switching cam at which said first cam portion again faces against said second portion of said switch lever is so determined that said switch lever is held in said start position so as to maintain said switch means in said one operating condition with said third portion of said switch lever being spaced from said timing cam, thereby determining a second manual set position of said time switch mechanism, and said initial position of said switching cam permitting automatic operation of said time switch mechanism.

* * * * *